US006849794B1

(12) United States Patent
Lau et al.

(10) Patent No.: US 6,849,794 B1
(45) Date of Patent: Feb. 1, 2005

(54) MULTIPLE CHANNEL SYSTEM

(76) Inventors: Ronnie C. Lau, 124 Storms Ave., #3J, Jersey City, NJ (US) 07306; Michael P. Lau, 124 Storms Ave., #3J, Jersey City, NJ (US) 07306

( * ) Notice: Subject to any disclaimer, the term of this patent is extended or adjusted under 35 U.S.C. 154(b) by 16 days.

(21) Appl. No.: 10/144,033

(22) Filed: May 14, 2002

Related U.S. Application Data

(60) Provisional application No. 60/290,360, filed on May 14, 2001.

(51) Int. Cl.[7] ..... G10H 1/06; G10H 7/00

(52) U.S. Cl. ..... 84/622; 84/609; 84/615; 84/649; 84/653; 84/659

(58) Field of Search ..... 84/600–602, 609–610, 84/615, 622–626, 633–634, 645, 649–650, 653, 659–662, 666

(56) References Cited

U.S. PATENT DOCUMENTS

| | | | | |
|---|---|---|---|---|
| 2,783,677 A | | 3/1957 | Becker | |
| 3,757,046 A | | 9/1973 | Williams | |
| 3,757,047 A | | 9/1973 | Ito et al. | |
| 5,533,129 A | | 7/1996 | Gefvert | |
| 5,771,295 A | | 6/1998 | Waller, Jr. | |
| 5,850,457 A | | 12/1998 | Gefvert | |
| 5,899,774 A | | 5/1999 | Sexton | |
| 5,977,471 A | * | 11/1999 | Rosenzweig | 84/633 |
| 6,066,984 A | | 5/2000 | Tomaru et al. | |
| 6,072,878 A | | 6/2000 | Moorer | |
| 6,160,953 A | | 12/2000 | Fuchigami et al. | |
| 6,248,946 B1 | * | 6/2001 | Dwek | 84/609 |
| 6,288,319 B1 | * | 9/2001 | Catona | 84/609 |
| 6,423,893 B1 | * | 7/2002 | Sung et al. | 84/645 |
| 6,570,080 B1 | * | 5/2003 | Hasegawa et al. | 84/609 |
| 6,574,243 B2 | * | 6/2003 | Tsunoda et al. | 84/645 |

* cited by examiner

*Primary Examiner*—Marlon T. Fletcher
(74) *Attorney, Agent, or Firm*—James Creighton Wray; Meera P. Narasimhan

(57) ABSTRACT

A server stores audio and coordinated video digital files in a library, and upon requests supplies individual files to multiple dedicates processors under sole control of the server. Music files have separate vocal and specific instrument channels. The processor supplies single channels to amplifiers and speakers having controlled frequency ranges capable of reproducing only the frequencies on the individual channels. Images from the video files are projected on screens around and above an audience seated on swivel chairs. Coordinated sounds emanate from speakers distributed over the screens. Bus-like wiring extends, from the processor. Individual speaker wires connect to ends of bundled conductors.

27 Claims, 10 Drawing Sheets

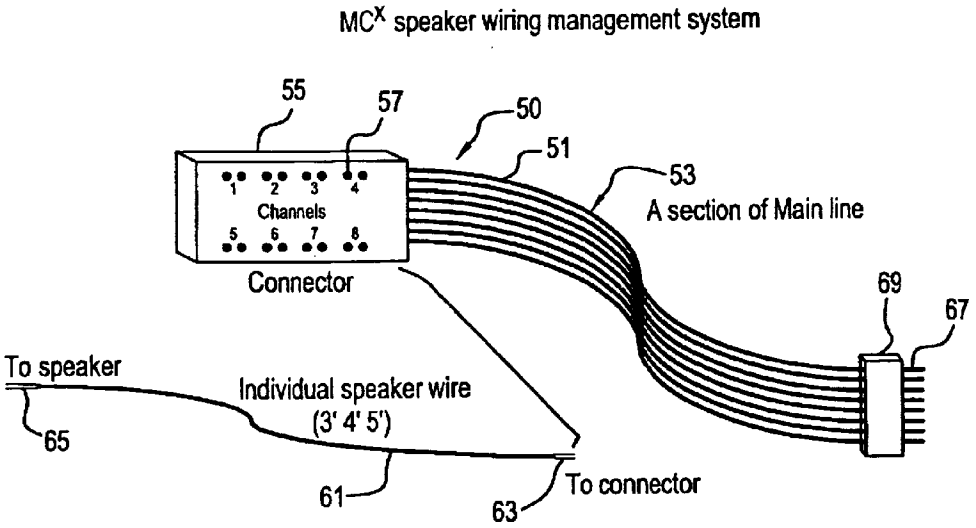

Description

- Main line is a ribbon-wire system made up by various sections ( 5' 8' 12' etc.) in a listening area.
- Each section has a Connector that provides 8 contact points to 8 separate channels.
- Position the Main line along the baseboards of the listening area (it can be fastened down) then plug-in all the individual speaker wires from each speaker to the connectors. Any channel of sound can be easily be repositioned by re-plugging each speaker to a different contact point at any connector.
- No messy wires that tangle up, no need to trace each speaker wire back to the amplifier etc.

FIG. 6

MCV with MCS Theaters

Multiple Movable Screens Technique
Top and main screen stationary

MCV and MCS in a 3-D Dome Theater

Plan view- a dome shape screen technique

SECTION B-B

MULTIPLE CHANNEL SYSTEM

This application claims the benefit of U.S. Provisional Application No. 60/290,360, filed May 14, 2001.

BACKGROUND OF THE INVENTION

A common sound system utilizes only two to five channels and possibly even fewer amps and speakers. Those systems playing a musical performance, for example, may have two channels dividing up many sounds. These sounds are usually amplified through two speakers. This type of application does not recreate the original sound or create a sound similar to a live performance because multiple sounds travel through only a small number of channels, less channels than sounds utilized, and through a small number of speakers. Those other types of systems are used for musical and non-musical applications, such as story telling, radio, talk shows, panel discussions and more. A typical live performance, a concert or a studio recording for example, may have each instrument assigned to its own channel or to its own multiple channels.

A common multiple channel sound system may use 2 to 6 or even 8 or more channels to re-create sound. Popularly known as "stereo" and "surround sound", that concept creates a sound field for a pre-designated listening area. This is accomplished through the use of multiple speakers placed uniformly surrounding the listening area. Usually, there are front speakers and rear speakers. All sounds are divided among the speakers. Using electronic effects to fabricate realism, the sounds can be simulated for different listening environments. All effects are lost when the listener drifts away from the designated listening area. These conditions and restraints are unavoidable, because those systems set forth to re-create a single, pre-designated sound field. A sound field is arranged by a recording engineer and permanently recorded onto the music during the mastering process for that song.

There are currently two products are of interest, DVD-A (DVD audio) and SACD (super audio CD).

Six channels are used to record and play music. Usually there are five full-range speaker sets (three front, two rear) and a subwoofer. These systems try to introduce some realism in the music being played. They accomplish that by reformatting each instrument and voice to a reference location. (For example: guitar at 50 degrees to the left, keyboard 35 degrees to the right).

A recording engineer is required to create this sound field. By the example specifications, guitar sounds would be heard more from the left front speaker and a bit from the center speaker. Keyboard would have about the same level from the center and the right speakers. All sounds would have some kinds of ambient feed back on the two rear speakers and extra low frequencies will come out from the subwoofer to add warmness to the sounds.

The prior art uses full range speakers and surround sound gadgets. Those prior arts use a concept to try to re-create a sound field. A sound field that is established by a recording engineer during the mastering of that song and can never be changed by the user. They do not re-create the sounds of the original recordings and never can they replicate a live performance.

The sound field is set by the recording engineer and cannot be changed. This sound field is designed assuming that the listening position is in the center, with all speakers surrounding it at somewhat equal distances. If the listener moves away from that position, the effects of realism are eliminated.

DVD-A has support from Panasonics and Warner Advance Media Operation. Panasonics has also formed a joint venture with Universal Music, presumably to promote DVD-A music. SACD is supported by Sony and Phillips. The current free MP3 sites and other sites that distribute music illegally are detrimental to legitimate music sales. As long as music resides in the stereo format, there is no way to prevent piracy.

Current formats in motion picture and video broadcast deliver its content through a single screen. The playing of VCR and DVD are inclusive in this format. Having all of the featured content on a single screen limits the imagination and the realism of the actual scene, taking place in a 3-dimensional world. The prior art uses the screen to show the close-up detail shots as well as the overall big picture. When the close-ups are displayed on screen, the big picture and the rest of the scenes are not shown. Vice versa, when the big picture is on screen, one cannot see much detail.

The prior art uses speakers strategically positioned to replicate a reproduction of a sound field. This sound field is supposed to create realism to correspond with the video of the single screen playing. For example, if a Sting missile is fired from the left of the screen and hits the target on the right, the sound tracing of the missile and the explosion can be done by those speakers located on the left, center and right. But, when the missile is fired from the front left and hits a target at the right rear of the audience, the sound tracing and explosion are still possible by the prior art, but the explosion scene will be on the front single screen not very real to the human senses.

The prior art in motion picture and video display have been around for a long time. Those who have been producing movies that way are running out of ideas to make a film exciting.

Needs exist for better and less expensive sound and visual systems.

SUMMARY OF THE INVENTION

A new system, which may be referred to as an MC or multiple channel system, fulfills needs of the prior art.

$MC^X$ Video employs a multiple screen technique to present video content. The multiple screens can be in different forms. One is three flat-screens arranged in a trapezoidal configuration; the other is a dome screen similar to that in a planetarium. Others are multiple screens strategically located around the audience, with a main screen at front center.

Musical instruments and vocal presentations that make up a song are split into different channels. A $MC^X$ audio system may split different sounds into different channels, allowing the sound to be played individually on separate speakers. For example, a song may be comprised of many instruments split onto several different channels. The lead vocal may be on channel 1; back up vocal- channel 2; rhythm guitar- 3; lead guitar- 4; keyboard- 5; bass- 6; drums-7, 8, 9, and 10, etc.

Each channel is a mono output to a speaker dedicated to play that channel's sound. Each channel is dedicated to only the sound assigned to it. Thus, channel 1 will only play the sound of the lead vocal, and if the rest of the channels are shut off, only the lead vocal's singing can be heard.

Speakers are specially designed to handle a specific range of frequencies for that channel's sound only. Speakers for channel 1 and 2 will only need to handle the human voice, which is mid-range; channel 3 is for the guitar's frequency range which is the mid-high range; channel 6 will be the low frequency for the bass, and so on. If speakers are not required to do so much, it is easy to design and make speakers that produce sound very close to the original sound being recorded.

For the type of songs referenced in the above example, by placing ten different speakers around a small room, one can hear the audio experience of a song similar to a live performance.

This embodiment does away with stereo pair speakers and surround sound gadgets. Those devices do not re-create the original recordings and never can replicate live performance, which is one of the ultimate musical enjoyments for musical lovers. This embodiment processes and plays broadcastings and recordings of sounds so that a true re-creation of the original is achievable.

By applying the concept that provides the sound of each instrument individually to the user, an $MC^X$ audio system can allow the user to create a sound field to cater to any personal preferences or to fit any listening area. This embodiment processes and plays broadcastings and recordings of sounds so that it is as true to a re-creation of the original is achievable. This embodiment provides an audio experience that is superior to any amplified, live performance.

$MC^X$ demonstrates its sound system along with the $MC^X$ formatted music in direct comparison with DVD-A. The audiences that have heard the system are music industry executives, financial executives, recording and performing artists, music producers, various business executives, and specialized groups of students and professors at several educational institutions. The only audience reaction is astonishment and fascination. Nobody can believe how simple the idea is but what a huge impact it makes on music as a whole. There has been no negative feedback; only shows of interest and offers of services and collaboration. Our cheap system sounds better than handmade high-end audiophile systems costing hundreds of times more.

Not only does the invention declare supremacy as a music system, but also the end user is provided many unique features for listening to the music. $MC^X$ is a product line that is well crafted and carefully designed to provide leadership for the next 100 years. For the professionals, it provides solutions to create ultimate musical presentations. For record labels, it employs technology of the future and is designed as a piracy-proof system to restore music sales. For the rest of the multimedia and entertainment industry, it provides brand new ideas to :make movies, shows, advertisements and presentations.

These and further and other objects and features of the invention are apparent in the disclosure, which includes the above and ongoing written specification, with the drawings.

BRIEF DESCRIPTION OF THE DRAWINGS

FIG. 6 is a perspective view of a wiring management system used with the new $MC^X$ system.

DETAILED DESCRIPTION OF THE PREFERRED EMBODIMENTS

One embodiment transforms existing recorded sound into multiple channel sound tracks so that each track is a solo of musical sound that can be played on the $MC^X$ Audio System 1. Since the more channels there are on the system, the better the sound, this embodiment encourages the multiple channels to be scalable. For example: in an average rock band, there are 4–10 main instrument sounds. The percussion and drum sections occupy 3–20 sounds. If a speaker is dedicated to representing each instrument, the quality of sound is increased by magnitudes.

Figure 1:
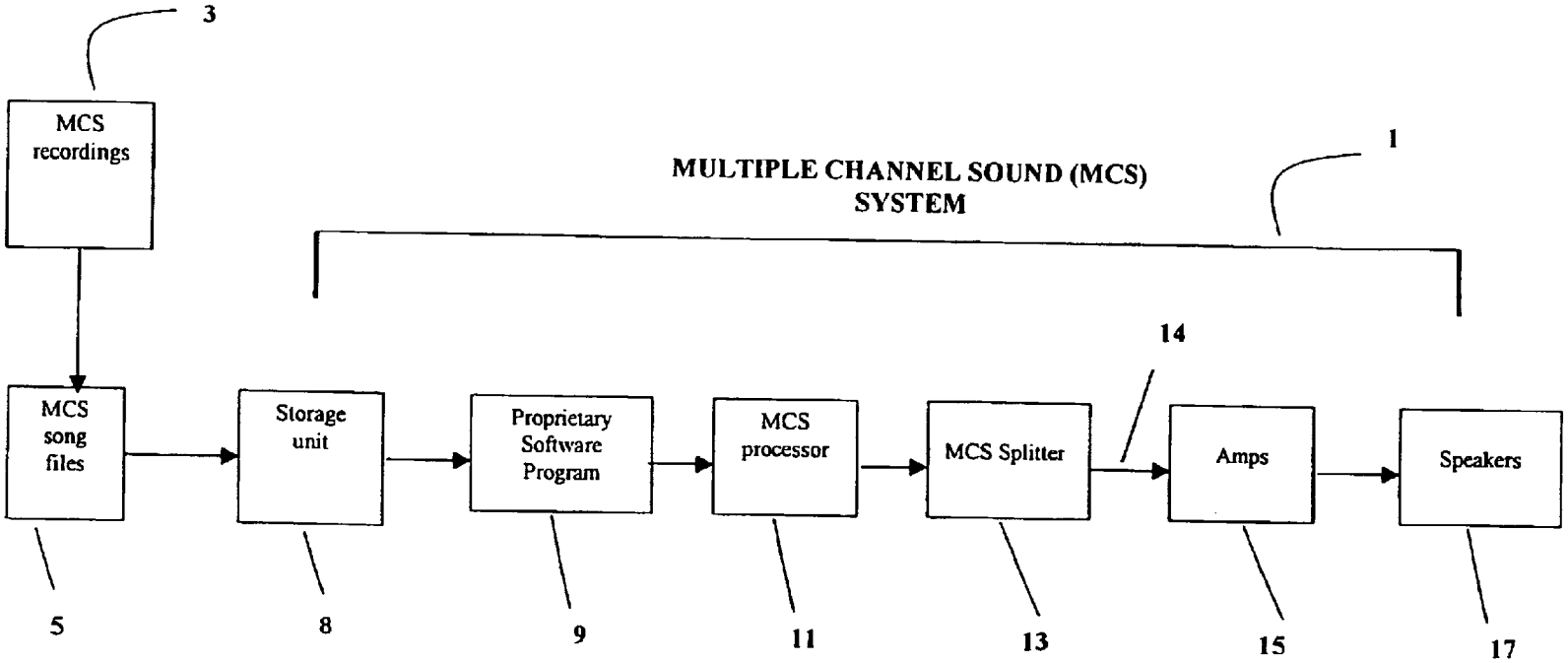
FIG. 1 is a flow chart of a preferred Multiple Channel ($MC^X$) system.
Figure 1A:
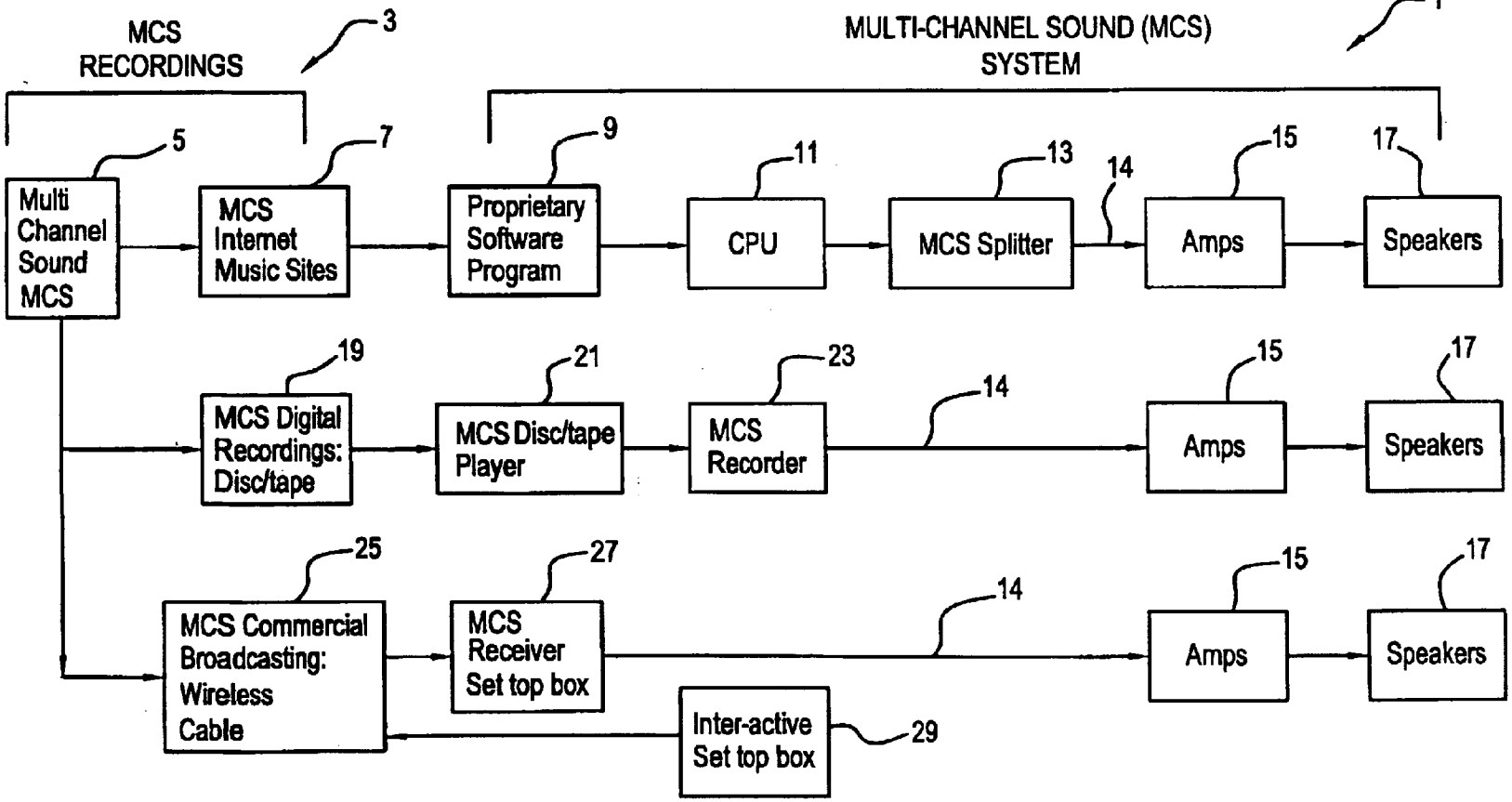
FIG. 1A is a flow chart of $MC^X$ Recordings being delivered through a $MC^X$ System having three different possible sources.

FIG. 1A shows the $MC^X$ System 1 using $MC^X$ recordings 3. The $MC^X$ 5 may be provided from, for example, three sources, either $MC^X$ Internet music storage sites 7, $MC^X$ digital recordings, discs or tapes 19, or $MC^X$ Commercial Broadcasting, wireless or cable 25.

Preferably, as shown in FIG. 1, a consumer takes individual song files 5 from $MC^X$ recordings 3 and stores those favorite song files in a storage unit 8. Using proprietary software 9, selected files are transferred to a $MC^X$ processor 11. An $MC^X$ splitter 13 splits the sound into individual feeds 14 to individual amplifiers 15 for individual speakers 17.

FIG. 1 shows the $MC^X$ system 1 utilizing $MC^X$ recordings 3. The $MC^X$ song files 5, created from $MC^X$ recordings 3 may be provided to the user from any source currently available or will be available in the future. (For example: $MC^X$ files may be transferred by internet connections, broadband communications, compact discs, digital versatile discs, portable hard drives, flash memory cards, satellite, etc.)

When an $MC^X$ System 1 receives $MC^X$ song files 5 from the available source, the $MC^X$ System 1 first stores the $MC^X$ song files 5 into the storage unit 8. In order to play the song, the user will have to select desired song using $MC^X$ proprietary software program 9, which will extract $MC^X$ song files 5 from storage unit 8 and send it to processor 11. From processor 11, an $MC^X$ splitter 13 works with the proprietary software program 9 to split the processed $MC^X$ signal into respective music channels 14 for output. From the multiple channel sound processor 11, the signals feed through the amplifier 15. The $MC^X$ signals then feed to the speakers 17. One speaker set 17 is allocated to each amplifier 15.

The $MC^X$ processor 11 manages and plays the sound of each channel. Each channel has its own amplifier 15, where the recorded sound can be attenuated. Any channel can be made solo to play by itself, muted to silence, or any level in between. Since the amplifier 15 and the corresponding speaker 17 are only handling a certain range of frequencies, it is now a very simple, efficient, low cost unit. Furthermore, this embodiment allows for a scalable hardware configuration.

When a consumer $MC^X$ System 1 downloads $MC^X$ 5 from the Internet, the consumer does so from an Internet $MC^X$ site 7. The consumer must have special software, such as a proprietary software program 9, installed on the consumer's processor or computer to communicate effectively with the $MC^X$ Internet sites. A CPU 11 having a 1 G processor, 256MB of RAM, and SCCSI HD processes $MC^X$ in real time. An $MC^X$ splitter 13 works with the proprietary software program 9 to split the processed $MC^X$ signal into respective music channels 14 for output. From the multiple channel sound processor 11, the $MC^X$ signals feed through the amplifiers 15. The $MC^X$ signals then feed to the speakers 17. One speaker 17 or a speaker set is allocated to each amplifier 15.

A consumer who purchases $MC^X$ recordings 19 and the new hardware devices can use the $MC^X$ System 1. The $MC^X$ 5 song files 5 are digitally recorded 19 onto tapes, floppy discs, compact discs or DVDs in multiple channels and ready to play back the $MC^X$ sounds. The $MC^X$ player and recorder has a $MC^X$ disc or tape player 21 and a $MC^X$ recorder 23 which splits the processed $MC^X$ signal into respective music channels 14 for output. The $MC^X$ signals feed through the amplifiers 15. One amplifier is allocated to each output channel. The signal then feeds through the speakers 17. One speaker 17 is allocated to each amplifier 15.

A consumer who receives and dials in sound programs from commercial broadcasting stations 25 can use the $MC^X$ System 1. $MC^X$ commercial broadcasting 25 may consist of a satellite or wireless or cable radio station broadcasting multiple channel sound or advertisements. The $MC^X$ Processor has a $MC^X$ receiver 27 or an inter-active set top box 29. The inter-active set top box 29 talks back to the broadcasting station by means of wireless or cable so that the consumer can dial in demands for certain material played. The Me receiver 27 may be a set top box or hardware device that receives the $MC^X$ signals from the air or through a cable and then converts and processes the $MC^X$ signal into multiple channel 14 material for output. The $MC^X$ signals feed through the amplifiers 15. One amplifier is allocated to each output channel. The signal then feeds through the speakers 17. One speaker 17 is allocated to each amplifier 15.

An embodiment facilitates the storage and playback of $MC^X$ 5. A CPU 11, special CD, tape or disc 19 may achieve the storage. A sound frequency is responsible for the playback. This device may have a special CD, tape, disc player 19 or computer running on special software. This device can also be a set top box 27 that receives a signal from the cable or wireless transmission 25. The sound frequency processor manages and plays the sound of each channel; adjustments to the recorded sound can be made to each channel. The sound frequency processor then sends the signal to a set of mono amplifiers, where the main attenuation of each channel is done. Each channel has its own amplifier. Since the amplifier 15 is only handling a certain range of frequencies, it is now a very simple, efficient, low cost unit. Furthermore, this embodiment allows for a scalable hardware configuration.

Figure 2:
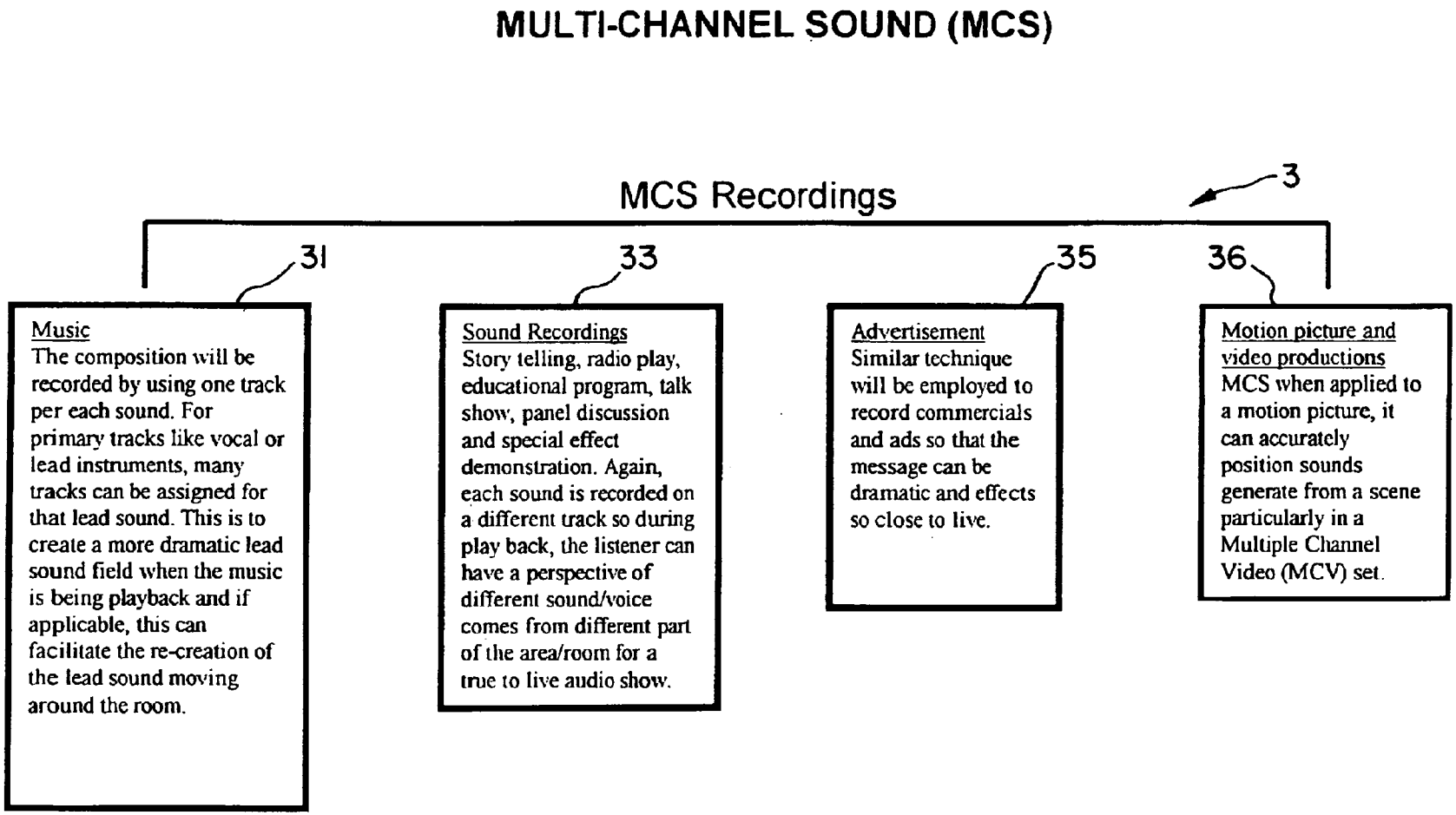
FIG. 2 describes some possible $MC^X$ recordings to be used for a $MC^X$ System.
Figure 3:
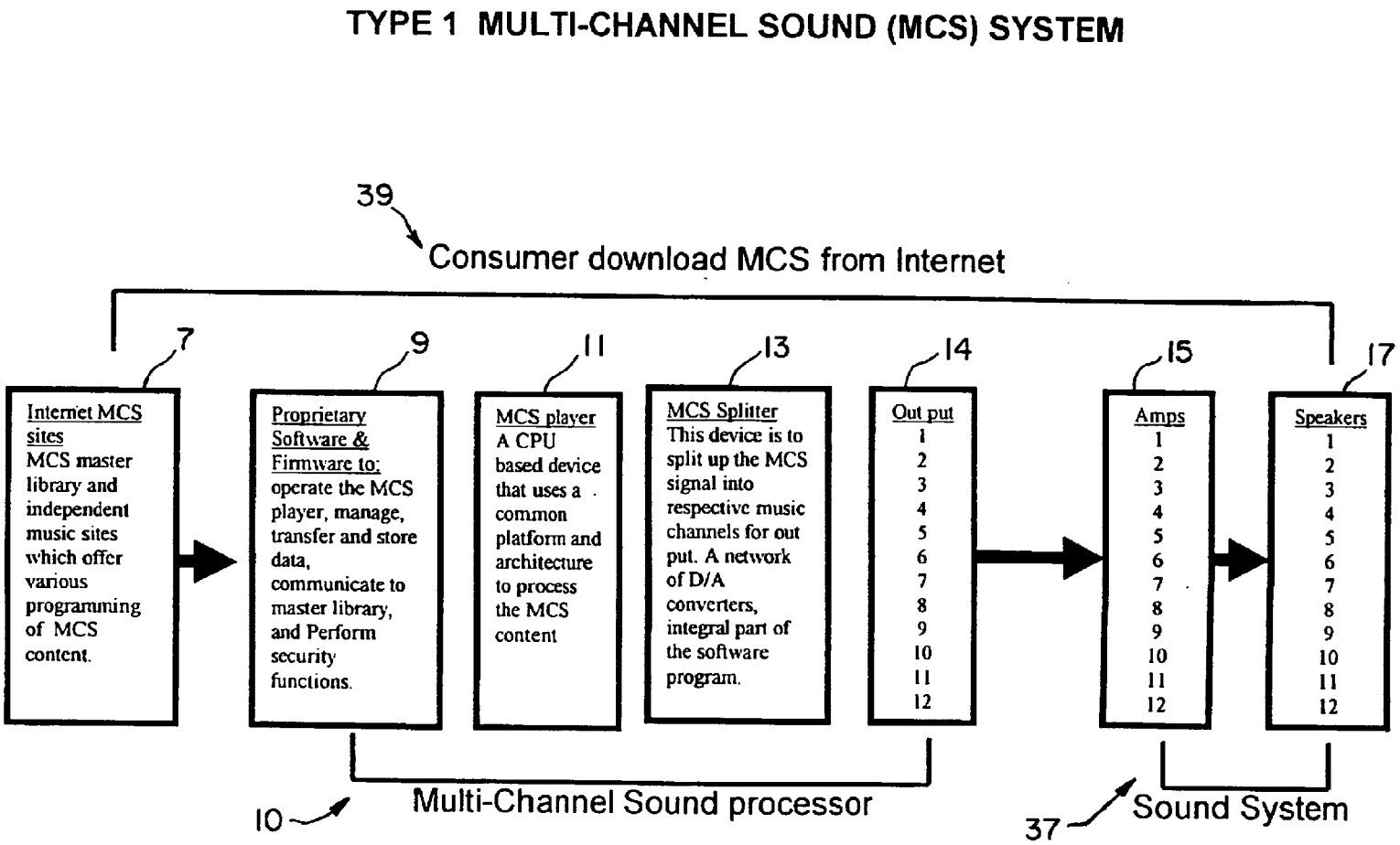
FIG. 3 is a flow chart of a $MC^X$ System utilizing consumer downloaded $MC^X$ from the Internet.

FIG. 2 is a flow chart describing four types of $MC^X$ recordings. Music recordings 31 are recorded by using one track per each sound. For primary tracks like vocal or lead instruments, many tracks can be assigned for that lead sound. This creates a more dramatic lead sound field when the music is being playback, and if applicable this can facilitate the re-creation of the lead sound moving around the room. Sound recordings 33, are provided by sources such as, yet not limited to, story tellings, radio playings, educational programs, talk shows, panel discussions and special effect demonstrations. Each sound is recorded on a different track so that during play back the listener can have a perspective of different sounds since the sounds and voices come from different parts of the area or room for a true to live audio show. Advertisements 35 can also be used in the $MC^X$ System 1. A similar technique records commercials and ads so that the messages can be dramatic and the effect can be as close to live as possible. When the $MC^X$ system is used in motion picture and video productions 36, sound generated from scenes are accurately positions around a viewing area;

As shown in FIG. 3, when a consumer $MC^X$ system 1 downloads $MC^X$ files 5 from the Internet 39, the consumer does so from an Internet $MC^X$ site with a storage unit 7. These are independent sites which offer various programming of the $MC^X$ video and music files. A multichannel sound processor 10 is used. The consumer must have special software, such as a proprietary software program 9, installed on the consumer's processor or computer to communicate effectively with the $MC^X$ Internet sites. A CPU 11 having a 1 G processor, 256 MB of RAM, and SCCSI HD processes $MC^X$ in real time. A $MC^X$ splitter 13 splits the $MC^X$ signal into respective music output channels 14. From the multiple channel sound processor 10, the $MC^X$ signals feed through the amplifiers 15. The $MC^X$ signals feed then to the sound system 37, having amplifiers and speakers. The signal feeds first through the amplifiers 15. One amplifier is allocated to each output channel. The signal then feeds through the speakers 17. One speaker 17 is allocated to each amplifier 15.

Figure 4:
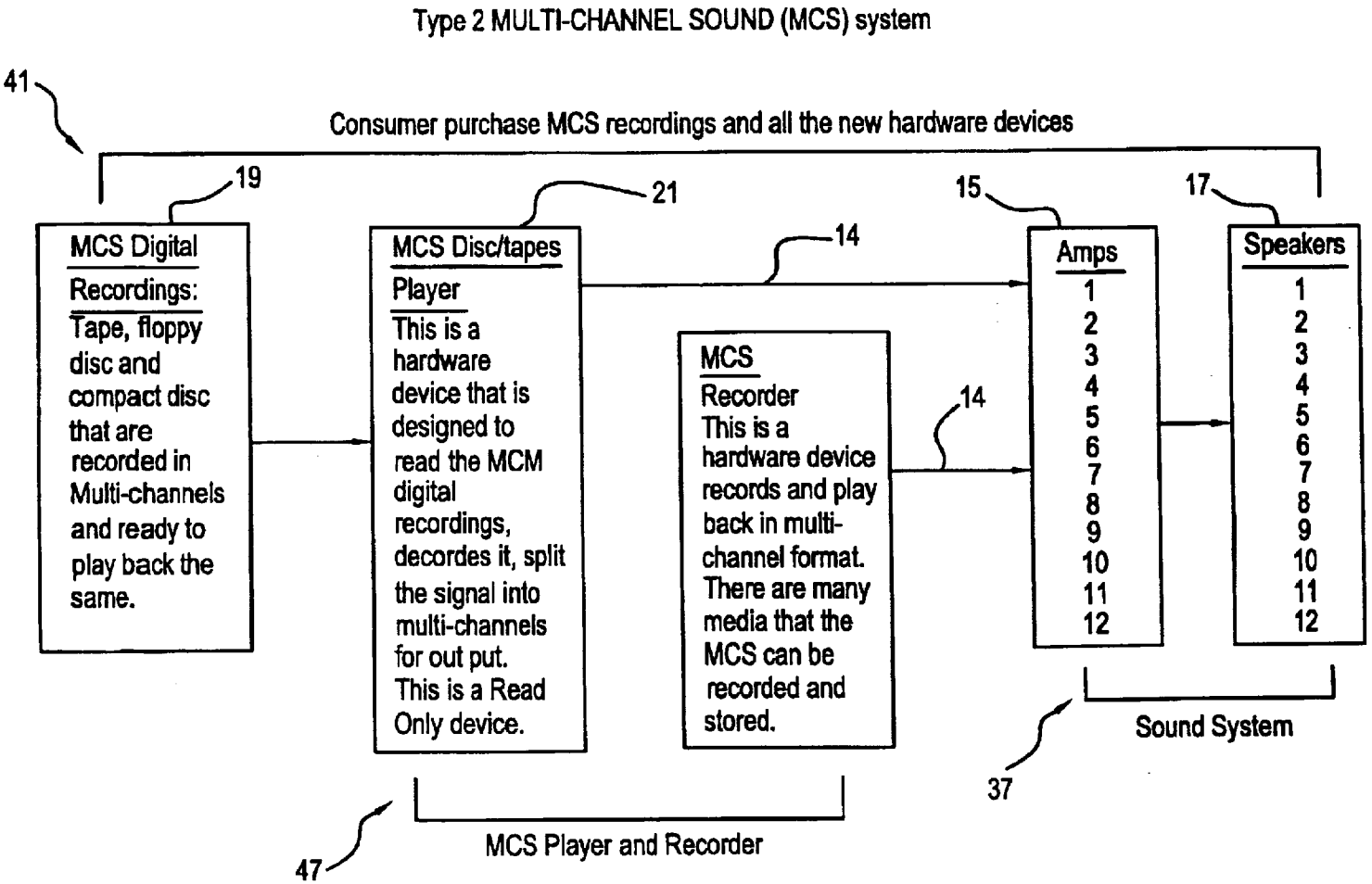
FIG. 4 is a flow chart of a $MC^X$ System utilizing consumer purchased $MC^X$ recordings.

FIG. 4 shows that a consumer who purchases $MC^X$ digital recordings 19 and the new hardware devices 41 can use the $MC^X$ System. $MC^X$ digital recordings 19 may be provided by tapes, floppy discs, compact discs, or DVDs recorded in multiple channels ready to play back $MC^X$ sounds. The $MC^X$ disc or tape player 21 reads the $MC^X$ digital recordings 19 decodes it, and splits the signal into multiple channels 14 for output. This is a read only device. From the $MC^X$ player and recorder 47, the $MC^X$ signals feeds then to the sound system 37, having amplifiers and speakers. The signal feeds first through the amplifier 15. One amplifier is allocated to each output channel. The signal then feeds through the speakers 17. One speaker 17 is allocated to each amplifier 15.

Figure 5:
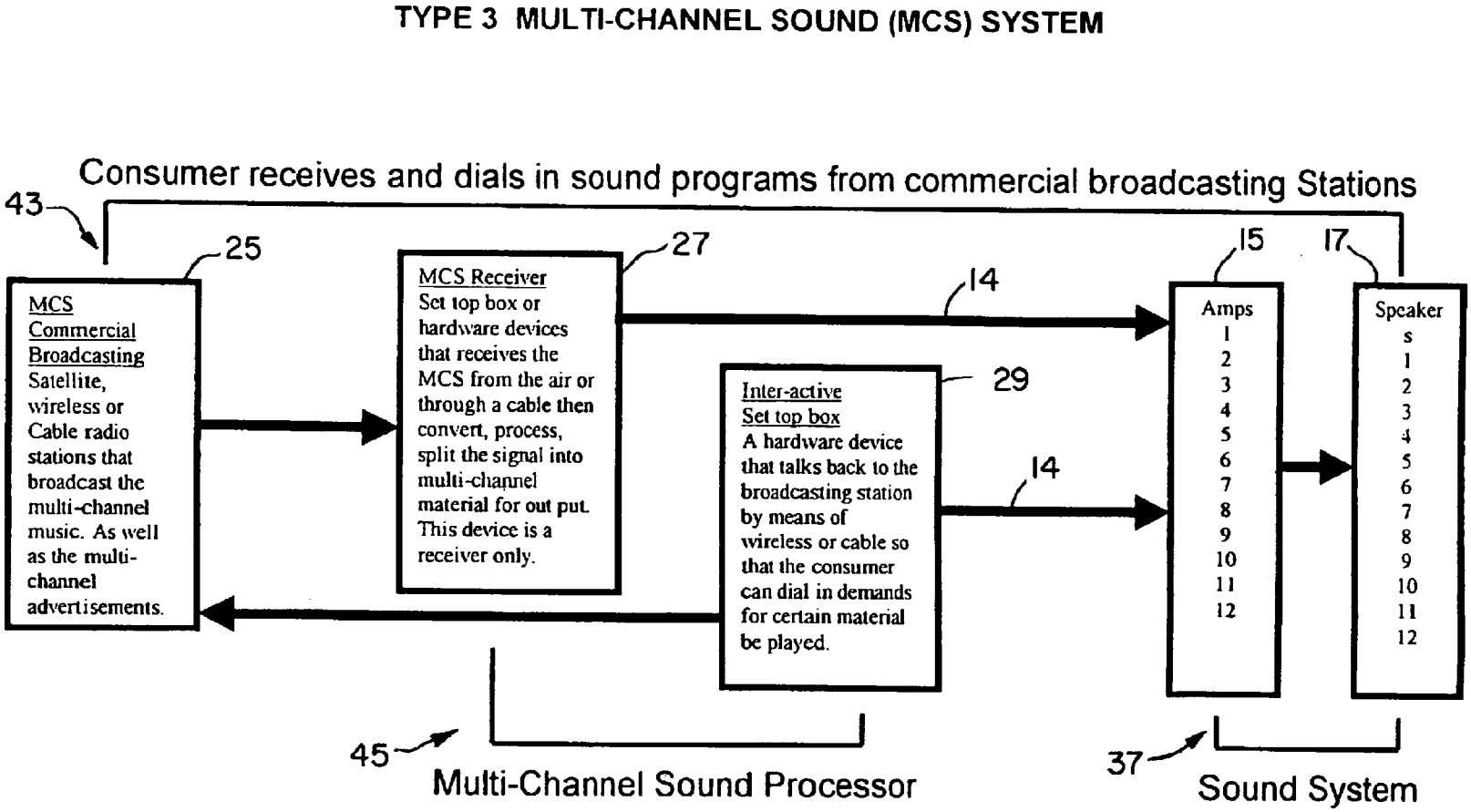
FIG. 5 is a flow chart of a $MC^X$ System utilizing sound programs received from commercial broadcasting stations.

FIG. 5 shows that consumers who receive and dials in sound programs form commercial broadcasting stations 43 can use the $MC^X$ System 1. $MC^X$ commercial broadcasting 25 may be provided by satellite, wireless or cable radio stations that broadcast the multiple channel music, sound or multiple channel advertisements. This signal may be received by the multiple channel sound processor 45 having a $MC^X$ receiver 27 and an inter-active set top box 29. The $MC^X$ Receiver 27 is a set top box or hardware device that receives the $MC^X$ from the air or through a cable. The receiver 27 then converts and processes the $MC^X$ signal into multiple channel 14 material for output. From the $MC^X$ receiver the $MC^X$ signals feed to the sound system 37, having amplifiers and speakers. The signal feeds first through the amplifier 15. One amplifier is allocated to each output channel. The signal then feeds through the speakers 17. One speaker 17 is allocated to each amplifier 15.

While the $MC^X$ receiver 27 is a receiver only, the interactive set top box 29 talks back to the broadcasting station or satellite 25 by means of wireless or cable so that the consumer can dial in demands for certain material to be played. The interactive set top box 29 then provides the multiple channel signal 14 for output. The $MC^X$ signals feeds then to the sound system 37, having amplifiers and speakers. The signal feeds first through the amplifier 15. One amplifier is allocated to each output channel. The signal then feeds through the speakers 17. One speaker 17 is allocated to each amplifier 15.

As shown in FIG. 6, a wiring management system is generally indicated by the numeral 50. Main line 51 is a ribbon-wire system made up by various section lengths (5', 8', 12' etc.) in a listening area. Each section 53 has a connector 55, that provides 8 contact point pairs 57 to 8 separate channels. Positioning the main line 51 along baseboards of the listening area, it can be fastened down. Then, all of the proximal ends 63 of individual 3, 4 or 5 foot speaker wires 61 from each speaker connector 65 are plugged in to the contact point pairs 57 of the connectors 55. Any channel of sound can be easily be repositioned by re-plugging each speaker to a different contact point pair 57 at any connector 55. No messy wires tangle; no need exists to trace each speaker wire back to the amplifier, etc. Each section 53 has pins 67 on an end 69 to connect to a processor.

Figure 7:
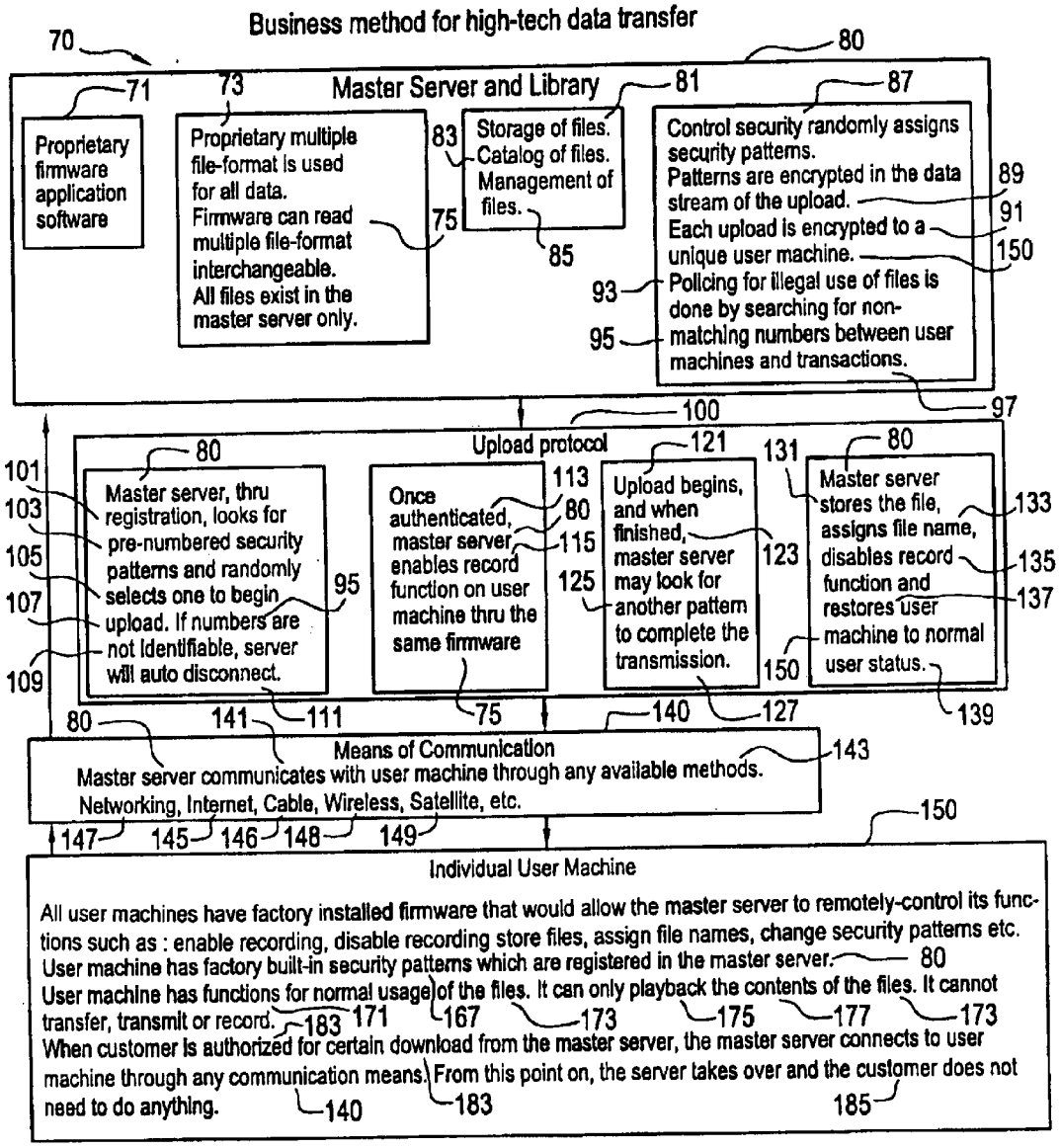
FIG. 7 is a flow chart showing how the system is used.

FIG. 7 shows a business method 70 for high tech data transfer for digital music and video, using a master server and library 80, with proprietary firmware application software 71. Proprietary multiple file-format 73 is used for all data. Firmware 75 can read multiple file-formats interchangeably. All files exist in the master server 80 only. The master server and library 80 are used for the storage of files 81, to catalog files 83 and for the management of files 85.

Control security randomly assigns security patterns 87. Patterns are encrypted in the data stream of the upload 89. Each upload is encrypted 91 to a unique user machine 150. Policing for illegal use of files 93 is done by searching for non-matching numbers 95 between user machines and transactions 97.

The system includes an upload protocol 100. Master server 80, through registration 101, looks for pre-numbered security patterns 103 and randomly selects one 105 to begin upload 107. If numbers 95 are not identifiable 109, server 80 will automatically disconnect 111.

Once authenticated 113, master server 80 enables record function 115 on user machine 150 through the same firmware 75. Upload 121 begins, and when finished 123, master server 80 may look for another pattern 125 to complete the transmission 127. Master server 80 stores the file 131, assigns file name 133, disables record function 135, and restores 137 user machine 150 to normal use status 139.

As a means of communication 140, master server 80 communicates 141 with user machine 150 through any available methods 143: Networking 147, Internet 145, Cable 146, Wireless 148, Satellite 149, etc.

An individual user machine is generally indicated by the numeral 150. All user machines 150 have factory installed firmware 151 that allows the master server 80 to remotely-control 153 the user machine functions 155, such as: enable recording 157, disable recording 159, store files 161, assign file names 163, change security patterns 165, etc.

A user machine 150 has factory built-in security patterns 167, which are registered in the master server 80. User machine 150 has functions 171 for normal usage of the files 173. It may only playback 175 the contents 177 of the files 173. It cannot transfer, transmit or record.

When a customer is authorized 181 for certain download 183 from the master server 80, the master server connects to user machine 150 through any communication means 140. From this point on, the server 80 takes over, and the customer 185 does not need to do anything.

It is ideal to have each instrument recorded to play back on a dedicated speaker that does not share with other sounds. However, this embodiment can also group similar sounds to share a speaker as a starter system, creating a practical system. This startup system, possibly consisting of twelve channels and twelve speakers, achieves excellent sound far superior to other speaker and sound systems. This embodiment further affords upgrade to 36 and 100 channels for example.

Figure 8:
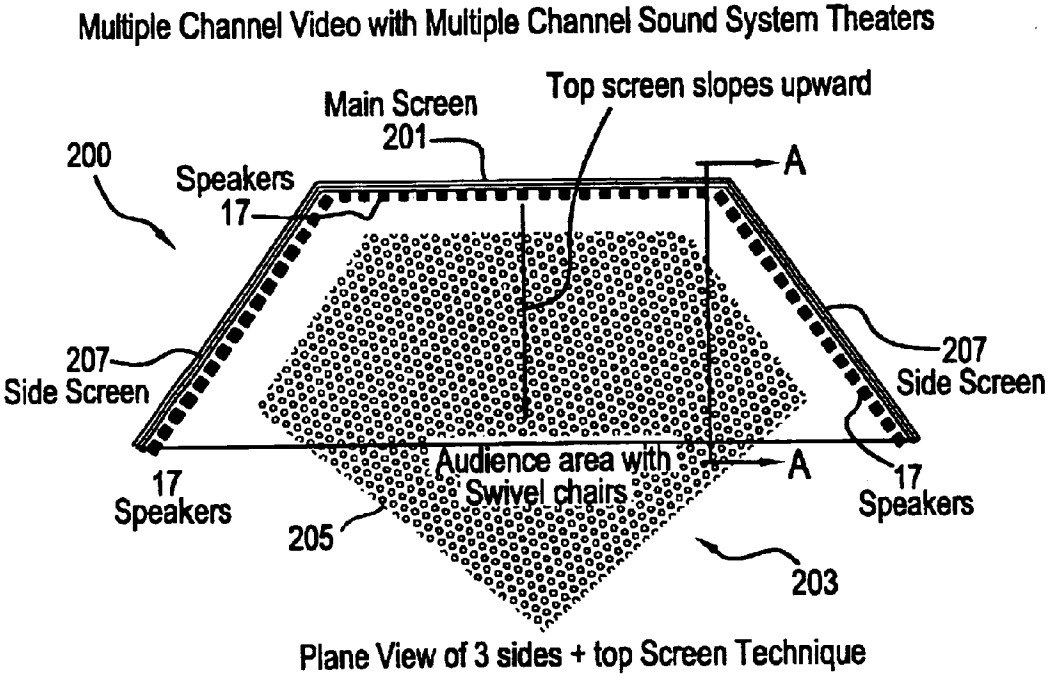
FIG. 8 shows a Multi Channel Video and Sound System theater.

Referring to FIG. 8, an $MC^X$ theater is generally indicated by the numeral 200. A main screen 201 is positioned in front of an audience area 203, having swivel seats 205. Side screens 207 are positioned at angles to the main screen. Speakers 17 are positioned along tops and bottoms of the screens.

Figure 9:
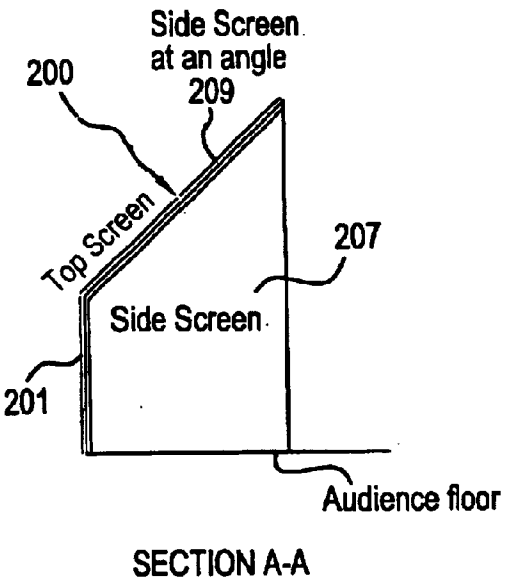
FIG. 9 is a cross-sectional detail taken along line AA in FIG. 8.

As shown in FIG. 9, a top screen 209 extends at an angle above the front screen 201 and the trapezoidal side screens 207. The side screens, main screen and top screen mutually join each other in continuous surfaces.

Figure 10:
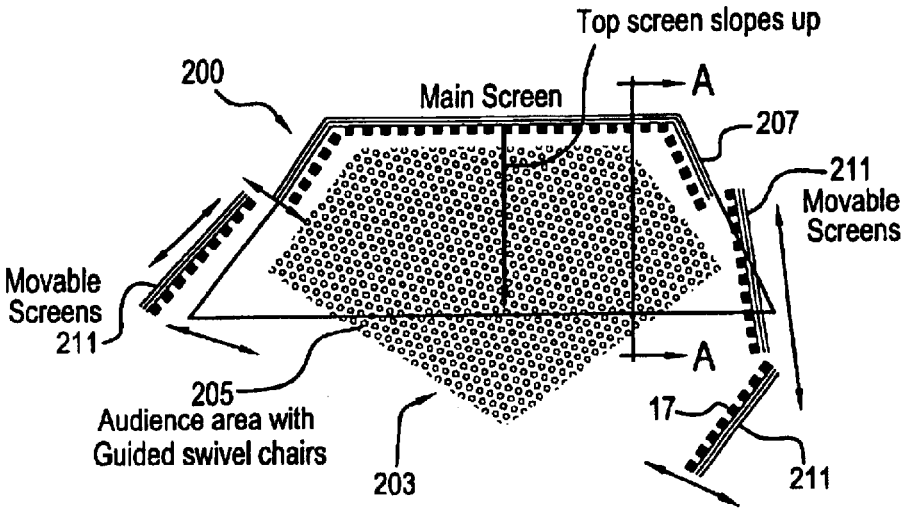
FIG. 10 shows a theater with movable screens.

As shown in FIG. 10, additional movable screens 211 may be provided. The top screen 209 and main screen 201 and parts 213 of the side screens 207 remain stationary. Speakers 17 are positioned at tops and bases of all screens 201, 207 and 211.

Figure 11:
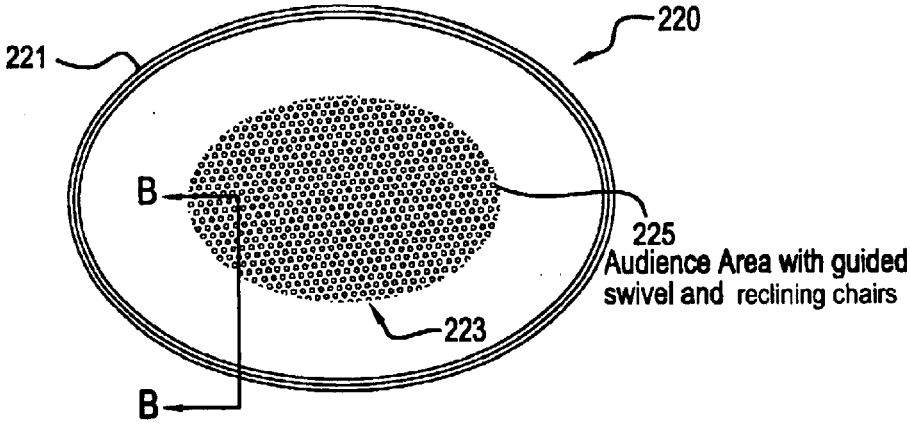
FIG. 11 shows a 3-D dome theater.
Figure 12:
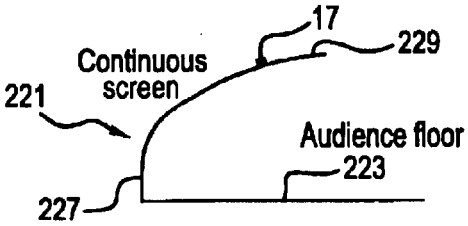
FIG. 12 is a cross-sectional detail taken along line BB of FIG. 11.

FIGS. 11 and 12 show a theater 220 with a continuous three-dimensional curved screen 221. An oval shaped audience area 223 has swivel seats 225. Curved wall screen 227 and curved dome 229 are formed as one continuous screen 21. Speakers 17 are placed at intervals behind the screen covering the entire dome 229.

The Product

The audible difference between $MC^X$ and any current audio system is that $MC^X$ can replay a recording to sound closer to the actual performance and do this without using electronic DSP (digital signal processing) sound effects. This achievement is the first detail to catch a consumer's interest.

The Sound System

The $MC^X$ sound system replays a song by transmitting each of the individual instruments or voices through a separate speaker powered by a separate amplifier. This way, each speaker is only required to handle a specific range of frequencies and is less likely to distort. The sound quality cannot be rivaled by current technology.

Each instrument's location can be customized by simply relocating the dedicated speaker. Not only is this element fascinating, the simplicity makes the product a practical high-tech machine.

In addition to the $MC^X$ supremacy in sound quality, the system allows the user to customize any composition by individually adjusting the gain controls of each instrument and voice, allowing the user to produce the music in accordance to their own preferences. This amazing feature will capture all musicians, singers, music producers and anyone who is a music lover. This is the first true step towards interactive music.

The $MC^X$ first generation product line will possibly produce all systems with a basic audio set having eight channels (eight amplifiers, eight speakers) to accommodate eight different sounds from a recording. The eight channels may be designed to have one dedicated channel for bass, one for lead vocal, two channels for drums and four channels for accompaniments in a wide range of musical instruments from wood-winds to brass, guitar to keyboard and background vocals.

The Music Player

The heart of the $MC^X$ system is a processor operated by a proprietary software program. This program performs two functions:

1. Store the song files and enable the user to playback the songs.
2. Enable the registered owner to purchase new songs through a special arrangement.

The Amplifier

The $MC^X$ proprietary amplifier contains multiple individual power amplifiers. This is also a very simple machine. Each amplifier is connected to its individual gain control and mute button to attenuate each instrument. There is a master volume control to provide overall loudness settings.

The Speaker System $MC^X$ speakers will be specially designed, each to recreate the sounds of a different instrument or voice. Basic speakers will be designed specifically towards sound types (i.e. woodwind, brass, vocal, etc). Upgrade speakers may re-create certain instruments (i.e. violin, trumpet, male tenor, etc) High-end speakers may be designed to sound like a specific instrument or voice (i.e. '57 Fender Strat electric guitar played on a vintage Fender tube amplifier, Steinway concert grand piano, Celine Dion at Carnegie Hall, etc.).

The Wiring System $MC^X$ uses a new wiring system to do away with messy and tangled wires. Speaker wires are fused together to form a flat ribbon with connectors at each end. Each section is 4–5 feet long. On each connector there are eight sets of contact plugs specially designed to allow connections to each individual channel (1–8). The user places this ribbon system only one time around the listening area. Then the user can relocate each channel of sound as desired without moving a bunch of loose wires.

Compatibility

The $MC^X$ sound system is absolutely compatible with any entertainment system currently on the market. Although promoted as a stand-alone system, $MC^X$ can be utilized as an upgrade in system format to any current sound system, and all of the new features are still available. Any amplifiers or speakers currently owned can be used with the $MC^X$ player, and $MC^X$ wires to play $MC^X$ music. The only drawbacks are the sound quality (Only $MC^X$ speakers are designed to reproduce specific sounds.) and appearance (Different styles or colors may have been used for different units.).

The Music

Current music can be easily re-formatted into the $MC^X$ system. New music can be recorded using conventional techniques and then mastered into $MC^X$ format.

All $MC^X$ song titles are stored in the master library server where all the songs are uniquely categorized by a special numeric coding system. The server can talk to each $MC^X$ music player and identify each customer by the serial number through a broadband connection. The server logs all the transfers as it sends them.

By using electronic communication, $MC^X$ can efficiently handle multiple sales of the same song to different customers all over the world.

An $MC^X$ song is sold to a customer using two methods:

1. By a broadband connection download directly from the server to the customer's $MC^X$ machine.
2. As an option, a customer can take the hard drive out of the $MC^X$ machine and go to a music store to purchase song titles and download them onto the hard drive.

Security

The security measure to prevent piracy of the music sales is in the $MC^X$ machine and the server. Both operate on proprietary software. The user's $MC^X$ machine does not have a record function operable by the user. That makes it impossible for users to transfer song files from one machine to another.

For all $MC^X$ songs at the point of transfer from the server, a set of codes are encrypted and embedded into the data stream of the song and into the purchaser's $MC^X$ machine. The purchaser's machine also is assigned a special code to receive that song at the beginning of the transfer. If need be, additional coding can be assigned at the middle of the transfer. The user's machine looks for these special numbers before it enables and completes the recording from the download. Without them, the program simply cannot record.

Since the download is controlled by the server (sender) and there is no recording media like a CD for duplication, it is safe, and the sales of the songs are indeed protected from illegal use.

$MC^X$ works with record-labels to restore thee healthy sales of music over the Internet or otherwise.

While the invention has been described with reference to specific embodiments, modifications and variations of the invention may be constructed without departing from the scope of the invention.

We claim:

1. A multiple channel sound system music process comprising storing multiple channel audio files in multiple separate channels in a dedicated server, connecting the server to multiple separate storage channels in each of multiple dedicated audio processors, downloading the audio files from the server to the processors under the sole control of the server upon off-line requests from owners of the processors, wherein the dedicated server downloads the audio files in the multiple separate channels only to the multiple separate channels in only the dedicated processors.

2. The process of claim 1, further comprising cataloging and managing the audio files in the server, assigning security patterns, communicating with the multiple dedicated audio processors though any available communications, policing for illegal use of files, and enabling recording of files on the dedicated processors before the downloading.

3. The process of claim 1, further comprising associating video files coordinated with the audio files, and storing and downloading the video files with the audio files under the sole control of the server.

4. The process of claim 3, further comprising displaying video from the video files and playing sound from the audio files in a theater, providing a main screen, side screens and a top screen, projecting images from the video files on the screens, and concurrently producing coordinated sounds from the audio files on individual speakers positioned along the screens.

5. The process of claim 4, wherein the side screens are movable.

6. The process of claim 4, wherein the main screen, side screens and top screen form a dome having curved side walls, wherein the images from the video are projected over the dome and curved side wall screens, wherein the speakers are provided behind the dome and side wall screens, and wherein the coordinated sound is produced over the screens.

7. The process of claim 4, wherein the speakers are connected to amplifiers and to one of the dedicated processors by a managed wiring system having bundled parallel wires, an end with pins for connecting to one of the dedicated processors, and a connector with connections for receiving ends of speaker wires.

8. The multiple channel sound system music process of claim 1, further comprising providing the server as a digital music source having multiple distinct tracks, each track being dedicated to a particular musical instrument or to voice, providing a player having multiple distinct channels, each channel being assigned to one distinct track, and each distinct channel having a particular frequency range with a center frequency associated with the particular musical instrument or voice assigned to that channel, providing multiple individual distinct amplifiers in the player, each distinct amplifier being assigned to a particular channel and having a frequency range associated with the particular musical instrument or voice to which that amplifier and that particular channel is assigned, providing multiple connectors connected individually to the multiple amplifiers, providing multiple individual speakers connected individually to the multiple connectors, each speaker having a particular limited frequency range with a particular center frequency associated with the particular musical instrument or voice to which the particular distinct track, the particular distinct channel and the particular distinct amplifier are assigned.

9. The music system process of claim 8, further comprising providing a ribbon connector system for the music system having multiple laterally joined conductors, providing first connectors on first ends of the conductors for connecting the multiple wires to individual outputs of multiple amplifiers, and providing second connectors on second ends of the conductors for individually connecting the conductors to separate speaker wires.

10. A multiple channel sound system music process of claim 1, further comprising providing a digital music source having multiple distinct tracks, each track being dedicated to a distinct sound of a particular musical instrument or voice, supplying each track separately as a channel to the server, providing a player having multiple channels, each channel being assigned to one distinct channel, providing multiple individual distinct amplifiers, each distinct amplifier being connected to and assigned to a particular channel and having a frequency range associated with the sound of the particular musical instrument or voice to which that amplifier and that particular channel is assigned, providing multiple connectors connected individually to the multiple amplifiers, providing multiple individual speakers connected individually to the multiple connectors, each speaker having a particular limited frequency range with a particular center frequency associated with the sound of the particular musical instrument or voice to which the particular distinct track, the particular channel and the particular distinct amplifier are assigned.

11. The sound system process of claim 10, wherein each channel is dedicated only to the sound assigned to it.

12. The sound system process of claim 10, wherein each channel provides a mono output to a particular speaker dedicated to play that particular channel's sound.

13. The sound system process of claim 10, wherein the providing multiple tracks, channels, amplifiers and speakers comprise providing ten or more tracks, channels amplifiers and speakers.

14. The sound system process of claim 10, wherein, for example, the providing further comprises providing two individual tracks, channels, amplifiers and speakers handling mid ranges for human voice, providing two tracks, channels, amplifiers and speakers handling ranges for percussion instruments, providing one channel, amplifier and speaker assigned to keyboard, one channel, amplifier and speaker assigned to rhythm guitar, one to lead guitar, and one to base or any other combinations and assignments of sound to the tracks, the channels, the amplifiers and the speaker.

15. The sound system process of claim 10, wherein different individual track, channel, amplifier and speaker combinations are assigned to individual instrument sections of an orchestra.

16. The sound system process of claim 10, further comprising providing coordinated video reproduction apparatus for projecting video images near the speakers.

17. The sound system process of claim 16, wherein the providing video reproduction apparatus comprises providing multiple video projectors.

18. The sound system process of claim 16, wherein the providing video reproduction apparatus comprises providing multiple video projectors and multiple screens for displaying the video images.

19. The music process of claim 1, further comprising providing a processor for instrument or voice, providing a player having multiple channels, each channel being assigned to one distinct channel of the server, providing multiple individual distinct amplifiers, each distinct amplifier being connected to and assigned to a particular channel and having a frequency range associated with the sound of the particular musical instrument or voice to which that amplifier and that particular channel is assigned, providing multiple connectors connected individually to the multiple amplifiers, providing multiple individual speakers connected, individually to the multiple connectors, each speaker having a particular limited frequency range with a particular center frequency associated with the sound of the particular musical instrument or voice to which the particular distinct track, the particular channel and the particular distinct amplifier are assigned.

20. The music system process of claim 19, further comprising providing a server for transmitting music files to the processor and providing storage in the processor for storing the music files.

21. The music system process of claim 19, further comprising providing the server for transmitting music files in the multiple channels to the processor and providing storage in the processor for storing the music files in the multiple channels, and providing a control in the server for activating the storage in the processor for receiving the music files from the server.

22. The music system process of claim 20, wherein the providing the processor further comprises providing song file select and volume controls in the processor.

23. The music system process of claim 22, wherein the processor has no digital data transfer control.

24. A multiple channel sound system music process comprising storing multiple channel audio files in multiple separate channels in a dedicated server, connecting the server to multiple separate storage channels in each of multiple dedicated audio processors, downloading the audio files from the server to the processors under the sole control of the server upon requests from owners of the processors, wherein the dedicated server downloads the audio files in the multiple separate channels only to the multiple separate channels in only the dedicated processors.

25. The music system of claim 24, wherein the requests are off-line requests.

26. The sound system process of claim 24, wherein the providing multiple tracks, channels, amplifiers and speakers comprise providing two or more tracks, channels amplifiers and speakers.

27. The sound system process of claim 24, wherein, for example, the providing further comprises providing one or multiple individual tracks, channels, amplifiers and speakers handling mid ranges for human voice, providing one or multiple tracks, channels, amplifiers and speakers handling ranges for percussion instruments, providing one or multiple channels, amplifier and speaker assigned to keyboard, one or multiple channels, amplifiers and speakers assigned to rhythm guitar, one or multiple to lead guitar, and one or multiple to base or any other combinations and assignments of sound to the tracks, the channels, the amplifiers and the speaker.

* * * * *